US005848925A

United States Patent [19]

Howard et al.

[11] Patent Number: 5,848,925

[45] Date of Patent: Dec. 15, 1998

[54] METHOD FOR FABRICATING AN ARRAY OF EDGE ELECTRON EMITTERS

[75] Inventors: Emmett Howard, Chandler; Curtis D. Moyer, Phoenix; James E. Jaskie, Scottsdale, all of Ariz.

[73] Assignee: Motorola Inc., Schaumburg, Ill.

[21] Appl. No.: 773,121

[22] Filed: Dec. 26, 1996

[51] Int. Cl.[6] ..... H01J 9/02

[52] U.S. Cl. ..... 445/24; 445/50; 313/306

[58] Field of Search ..... 445/24, 50; 313/306

[56] References Cited

U.S. PATENT DOCUMENTS

| | | | |
|---|---|---|---|
| 4,650,435 | 3/1987 | Tamutus | 445/37 |
| 5,502,348 | 3/1996 | Moyer et al. | 313/306 |
| 5,545,946 | 8/1996 | Wiemann et al. | 313/306 |
| 5,691,600 | 11/1997 | Moyer et al. | 313/311 |

*Primary Examiner*—Kenneth J. Ramsey
*Attorney, Agent, or Firm*—Jasper W. Dockrey

[57] ABSTRACT

A method for fabricating an array (300) of edge electron emitters (530) includes the steps of: forming first and second grooves (310, 320) in first and second opposing planar surfaces (101, 102), respectively, of a supporting substrate (110) to form an array of openings (330) therethrough; forming a dielectric layer (122) on the first planar surface (101) and an emission structure (120) on the dielectric layer (122); forming a plurality of cathodes (132) on the emission structure (120); forming gates (515) on a portion of the surfaces defining the first grooves (310); forming a masking film (710) on the cathodes (132)/emission structure (120); removing an outer, radial portion (726) of the masking film (710); etching the emission structure (120), the retracted masking film (710) forming a mask, thereby providing a predetermined configuration of the edge electron emitters (530) with respect to the gates (515) and cathodes (132).

11 Claims, 8 Drawing Sheets

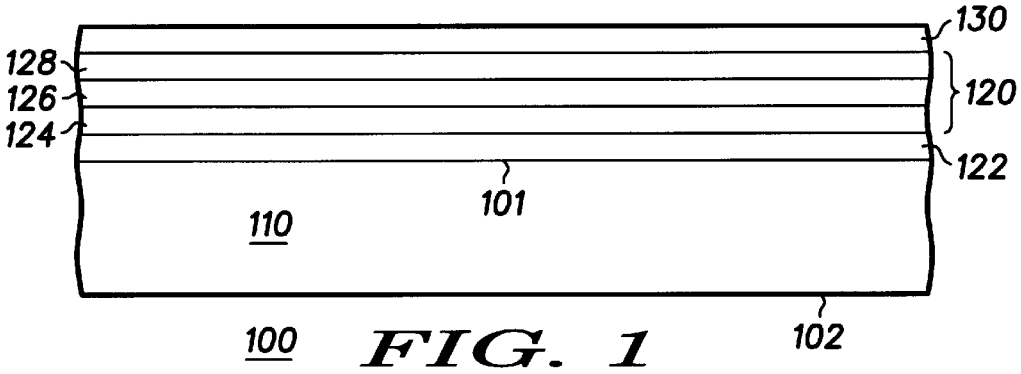
FIG. 1
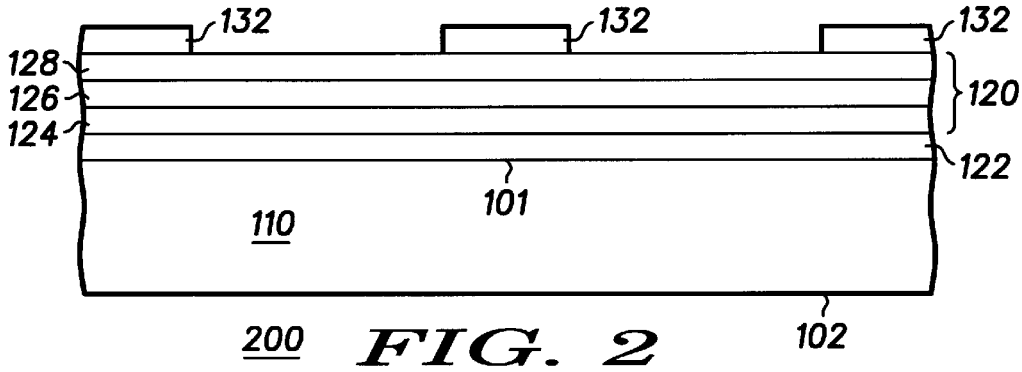
FIG. 2
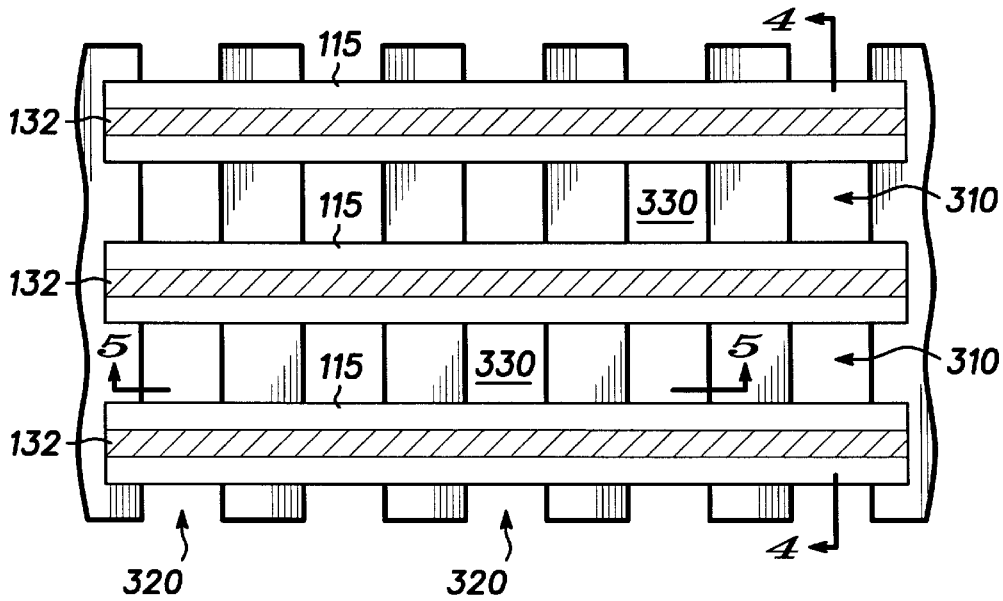
300 FIG. 3

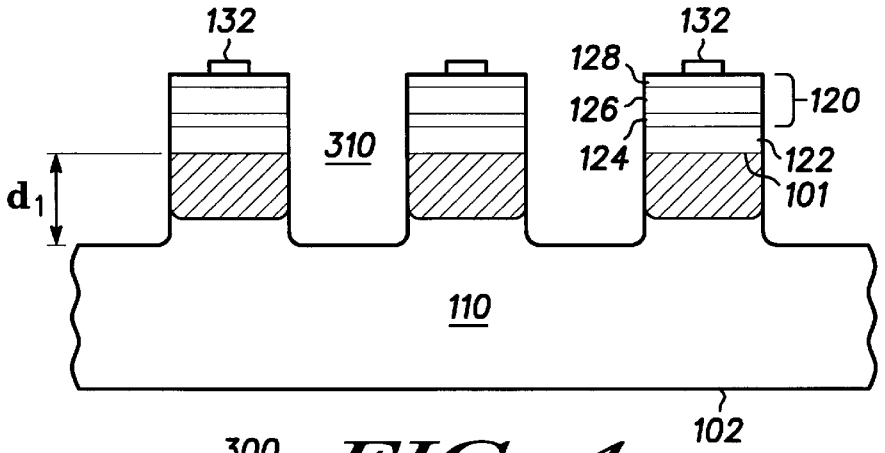
300 FIG. 4
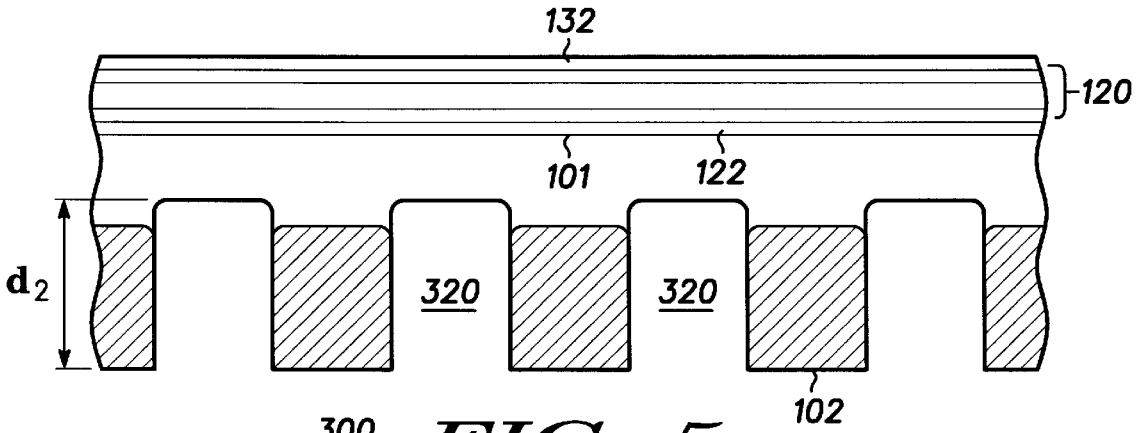
300 FIG. 5
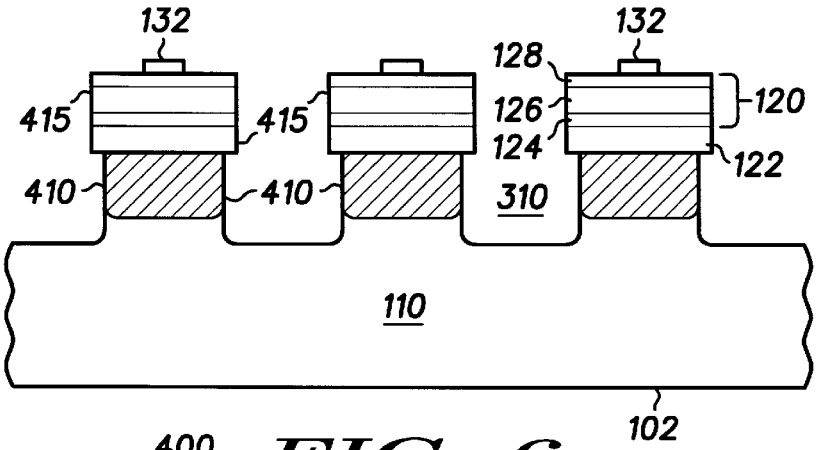
400 FIG. 6

700

800

900

METHOD FOR FABRICATING AN ARRAY OF EDGE ELECTRON EMITTERS

FIELD OF THE INVENTION

The present invention pertains to the area of field emission devices and, more particularly, to an array of edge electron emitters.

BACKGROUND OF THE INVENTION

Field emission devices, including edge electron emitters, are known in the art. Unlike Spindt-tip field emitters, edge emitters are simpler to make and eliminate problems such as shorts between emitter tip and grid, too much grid current, deteriorating tips, and exploding tips.

To provide optimum field characteristics at the electron emitting edge, and to provide the predetermined ballasting between the electron-emitting edge and the cathode and gate electrodes, the electron-emitting edge must be precisely positioned with respect to the cathode and gate electrodes. However, present schemes for establishing these configurations are imprecise, introducing unacceptable error which adversely effects pixel-to-pixel uniformity of emission characteristics. Conventional patterning schemes require the formation of a hard mask, accurate alignment of the hard mask, and resist developing steps, thereby introducing multiple processing steps. One scheme for positioning an edge electron emitter includes a step of clipping layers, including the emissive layer, so that the emissive edge is positioned flush with an extraction gate layer. However, the clipping or tearing of the emissive layer introduces several disadvantages. For example, it is well known that sharp features, such as sharp tips or edges, create locally enhanced electric fields which result in enhanced local electron emission at the sharp features. The clipping procedure creates undesired sharp features and results in non-uniform electron emission along the emission edge and throughout the emissive device. If the device is used in a field emission display, these non-uniformities create a mixture of bright and dim regions in the display image. Furthermore, the clipping off process introduces particulates within the device which can cause fatal gate-to-cathode shorting. Tearing creates drawn out stringers which can also cause shorting.

Accordingly, there exists a need for an improved method for fabricating an array of edge electron emitters which is low-cost, simple to perform, has fewer processing steps, and provides the precision necessary to realize uniform emission over the array.

BRIEF DESCRIPTION OF THE DRAWINGS

Referring to the drawings:

FIGS. 1 and 2 are side elevational views of structures realized by performing various steps of a method for fabricating an array of edge electron emitters in accordance with the present invention;

FIG. 3 is a top plan view of an array realized by performing additional steps upon the structure of FIG. 2 of a method for fabricating an array of edge electron emitters in accordance with the present invention;

FIGS. 4 and 5 are cross-sectional views of the array of FIG. 3 as seen from the lines 4—4 and 5—5, respectively, as indicated in FIG. 3;

FIG. 6 is a view similar to that of FIG. 4 of a structure realized by performing, upon the structure of FIG. 4, an additional step of a method for fabricating an array of edge electron emitters in accordance with the present invention;

DESCRIPTION OF THE PREFERRED EMBODIMENTS

Figure 7:
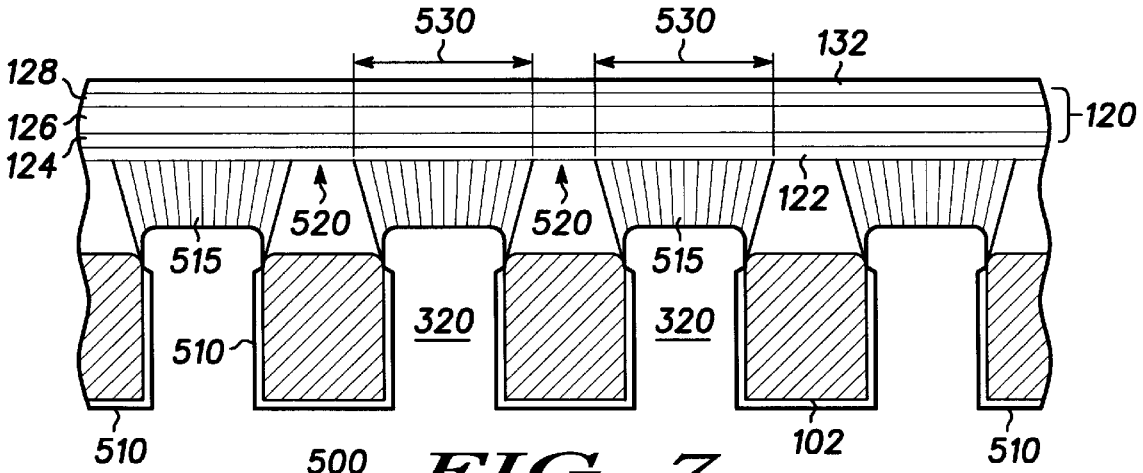
FIG. 7 is a view similar to that of FIG. 5 of a structure realized by performing, upon the structure of FIG. 5, an additional step of a method for fabricating an array of edge electron emitters in accordance with the present invention.

A method for fabricating an array of edge electron emitters, in accordance with the present invention, includes steps for realizing a predetermined configuration of the edge electron emitters with respect to the electrodes of the device. The present method achieves the important advantage of uniform emission characteristics over the array by providing precision and uniformity in said predetermined configuration. Another important benefit of the present method is the realization of smooth emission edges which do not have undesired sharp features.

Edge emitting field emission devices are described in two U.S. patents and one co-pending U.S. patent application, all of which are assigned to the same assignee. The first patent is entitled "Ballistic Charge Transport Device with Integral Active Contaminant Absorption Means", U.S. Pat. No. 5,502,348, filed on Dec. 17, 1993; the second patent is entitled "Field Emission Display with Getter in Vacuum Chamber", U.S. Pat. No. 5,545,946, filed on Dec. 17, 1993; and the patent application is entitled "Edge Electron Emitters for an Array of FED's", Ser. No. 08/489,017, filed on Jun. 08, 1995, by Moyer et al. Information pertaining to the operation of the field emission devices and the overall array disclosed in these patents and patent application is incorporated herein by reference.

Referring now to FIG. 1, there is depicted a side elevational view of a structure 100 realized by performing various steps of a method for fabricating an array of edge electron emitters, in accordance with the present invention. Structure 100 includes a supporting substrate 110, which is a generally plate-shaped, dielectric substrate formed of glass or any other rugged dielectric material. Supporting substrate 110 includes a first planar surface 101 and a second planar surface 102, which is spaced apart from, and generally parallel to, first planar surface 101. Upon first planar surface 101 are deposited a plurality of blanket layers including: a dielectric layer 122, a first resistive layer 124, an emissive layer 126, a second resistive layer 128, and a conductive layer 130. Layers 124, 126, 128 comprise an emission structure 120. Dielectric layer 122 includes a dielectric material such as silicon dioxide which is deposited upon first planar surface 101 by some convenient method, such as plasma enhanced chemical vapor deposition (PECVD), evaporating, sputtering, or the like. Dielectric layer 122 has a thickness of about 0.5 $\mu$m. In this particular embodiment, first resistive layer 124 is made from amorphous silicon and has a thickness of about 1000 angstroms. Emissive layer 126 is made from a field emissive material, generally known to have a low work function, less than about 1 eV. Emissive layer 126 is preferentially comprised of one of, for example, diamond, diamond-like carbon, non-crystalline diamond-like carbon, partially graphitized nanocrystalline carbon, aluminum nitride, and any other electron emissive material exhibiting surface work function of less than approximately 1.0 electron volts. In this particular embodiment, emissive layer 126 has a thickness of about 1500 angstroms.

Methods for forming field emissive films, including diamond-like carbon films, are known in the art. For example, an amorphous hydrogenated carbon film can be deposited by plasma-enhanced chemical vapor deposition using gas sources such as cyclohexane, n-hexane, and methane. One such method is described by Wang et al. in "Lithography Using Electron Beam Induced Etching of a Carbon Film", *J. Vac. Sci. Technol.* September/October 1995, pp. 1984–1987. The deposition of diamond films is described in U.S. Pat. No. 5,420,443 entitled "Microelectronic Structure Having an Array of Diamond Structures on a Nondiamond Substrate and Associated Fabrication Methods" by Dreifus et al., issued May 30, 1995. The deposition of a diamond-like carbon film is further described in "Lithographic Application of Diamond-like Carbon Films" by Seth et al., *Thin Solid Films,* 1995, pp. 92–95. Other suitable field emissive materials are described in the following patent applications, having the same assignee: "Electronemissive Film and Method" by Coll et al., Ser. No. 08/720,512, filed Sep. 30, 1996; and "Amorphous Multi-Layered Structure and Method of Making the Same" by Menu et al., Ser. No. 08/614,703, filed Mar. 13, 1996.

Second resistive layer 128 is made from amorphous silicon and has a thickness of about 1000 angstroms. Conductive layer 130 is made from a conductive material, such as aluminum or molybdenum. Layers 130, 128, 126, 124, and 122 are not drawn to scale. Their thicknesses are highly exaggerated in order to facilitate understanding.

Referring now to FIG. 2, there is depicted a side elevational view similar to FIG. 1, of a structure 200 realized by performing upon structure 100 (FIG. 1) the additional step of patterning conductive layer 130 to provide a plurality of cathodes 132. The patterning of conductive layer 130 may be achieved by conventional methods, including hardmask alignment, resist deposition, UV exposure, and resist development steps.

Referring now to FIG. 3, there is depicted a top plan view of an array 300 realized by performing upon structure 200 (FIG. 2) the additional steps of forming a plurality of parallel, laterally spaced apart first grooves 310 in first planar surface 101 to a first depth $d_1$ (FIG. 4) and forming a plurality of parallel, laterally spaced apart second grooves 320 in second planar surface 102 to a second depth $d_2$ (FIG. 5). Second grooves 320 are positioned so that each of second grooves 320 crosses each of first grooves 310 at an angle to first grooves 310, which, in this embodiment, is 90°. The combined total depth of $d_1$ and $d_2$ should be greater than the thickness of supporting substrate 110 so that an opening 330 is formed through supporting substrate 110 at each point or area where one of first grooves 310 intersects one of second grooves 320. Thus, supporting substrate 110 defines a two dimensional array of openings 330 positioned in rows and columns. First and second grooves 310, 320 may be formed by a sawing operation. First grooves 310 are formed one each in the regions of supporting substrate 110 that are between adjacent cathodes 132, which are used for alignment during the sawing operation. In this manner, a configuration is realized wherein plurality of cathodes 132 are disposed one each on a plurality of lands 115 defined by first planar surface 101, subsequent the formation of first grooves 310. Each of plurality of cathodes 132 extends over the length of one of the plurality of lands 115. In this particular embodiment, and in no way intended to be limiting, the width of each of first and second grooves 310, 320 is about 500 micrometers, and the width of each of plurality of lands 115 is also about 500 micrometers.

Many other suitable substrate configurations will occur to one skilled in the art. Due to the inherent self-alignment of the present process, a method in accordance with the present invention may be performed upon any one of these substrate configurations.

Referring now to FIGS. 4 and 5, there are depicted cross-sectional views of array 300 (FIG. 3) as seen from the lines 4—4 and 5—5, respectively in FIG. 3. To facilitate understanding, the thickness of layers 122, 124, 126, 128 and cathodes 132 are greatly enlarged and are not drawn to scale.

Referring now to FIG. 6, there is depicted a structure 400 realized by performing upon array 300 (FIGS. 3–5) the additional step of etching supporting substrate 110. An etchant, such as a solution of sulfuric acid, water, and HF, is used to etch the glass and create a retracted edge 410, which is displaced a lateral distance from each of a plurality of edges 415 defined by layers 122, 124, 126, 128.

Figure 8:
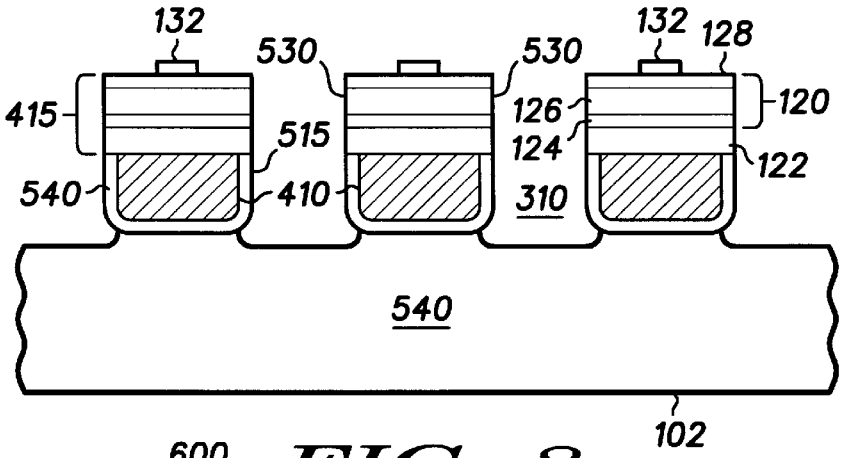
FIGS. 8–12 are views similar to that of FIG. 6 of structures realized by performing upon the structure of FIG. 6 additional steps of a method for fabricating an array of edge electron emitters, in accordance with the present invention.

Referring now to FIGS. 7 and 8, there are depicted views similar to those of FIGS. 5 and 6, respectively, of a structure 500 realized by performing upon structure 400 an additional step of the present method. This step includes forming a plurality of extraction electrodes 540 for addressing a plurality of edge electron emitters 530.

Extraction electrodes 540 are created by first forming a layer 510 of a conductive material on those portions of the surfaces defining first grooves 310 which face openings 330, and on the surfaces which define second grooves 320. Layer 510 is formed by depositing the conductive material from a source (not shown) beyond second planar surface 102 so that second planar surface 102 forms a shadow mask for the deposition. In this manner, a plurality of gaps 520 occur in layer 510 on the opposing surfaces defining first grooves 310 (see FIG. 7). Those portions of layer 510 which define gaps 520 include a plurality of gates 515. This deposition can be performed by any well known method, such as electron beam evaporation. After depositing layer 510, conductive gate material formed on second planar surface 102 is removed therefrom by a convenient method such as polishing, thereby realizing a structure 600, as depicted in FIG. 8, which is a view similar to that of FIG. 6, including plurality of electrically isolated extraction electrodes 540. Plurality of extraction electrodes 540 extend one each along plurality of second grooves 320. By removing the conductive material from second planar surface 102, extraction electrodes 540 are electrically isolated from each other. In this manner, extraction electrodes 540 and cathodes 132 provide addressability of the plurality of edge electron emitters 530 in the array. To realize structure 600, a low pressure etch of the conductive gate metal is also performed to remove gate metal deposited on edges 415 defined by layers 122, 124, 126, 128, and to remove gate metal deposited on the upper surfaces of second resistive layer 128. During this low pressure etch, those portions of layers 122, 124, 126, 128 which extend beyond retracted edge 410, in the direction of first groove 310, function as a mask to protect the conductive gate metal disposed beneath them.

For a gate metal which includes aluminum, this thin etch can be performed with a low pressure chlorine plasma in an RIE tool. As shown in FIG. 8, in the direction of one of second grooves 320, a continuous conductive layer defines one of extraction electrodes 540. A given edge electron emitter is addressed by applying suitable potentials to the extraction electrode and the cathode which together define the position of the given edge electron emitter within the addressable array.

Figure 9:
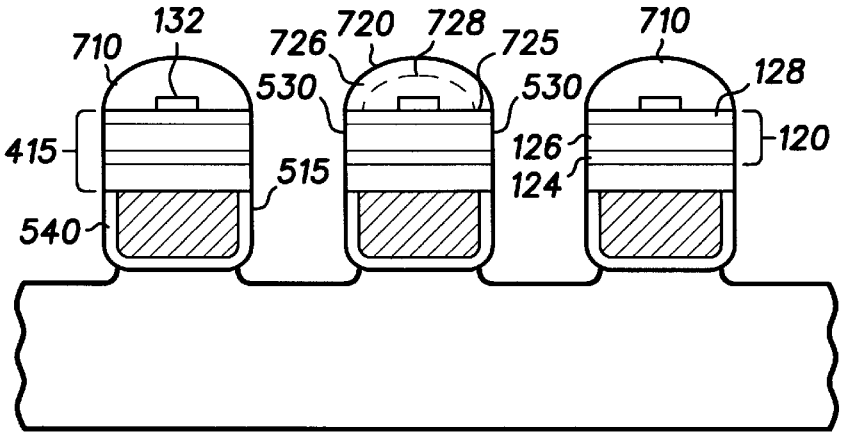

Referring now to FIG. 9, there is depicted a structure 700 which is realized by performing upon structure 600 (FIG. 8) the additional step of forming a masking film 710 on cathodes 132 and second resistive layer 128, in accordance with the present invention. Masking film 710 does not coat edges 415. Masking film 710 has a convex curved surface 720 defining a thin outer edge 725. Masking film 710 is formed by applying to the upper surface of structure 600 (FIG. 8), a liquid for which the cohesive forces between the constituent molecules are greater than the adhesive forces between the constituent molecules and the surfaces to which they are applied. The difference between these forces is sufficient to realize a configuration wherein the liquid only coats the upper surface of structure 600 and does not coat edges 415 defined by layers 122, 124, 126, 128. It is desired to be understood that the scope of the present method is in no way limited to the theory explaining the means by which masking film 710 selectively coats a substrate to achieve the configuration described herein. The material comprising masking film 710 is inert with respect to etchants employed during subsequent steps for etching the underlying layers. In this manner, masking film 710 forms a mask during these subsequent etch steps. In this particular embodiment, masking film 710 is made from a photoresist material. The photoresist material may include one of the following: product number SRC100-61CP resist provided by Shipley and AZ4400 resist provided by Huecht Celanese, both of which are positive photoresists. The resist material is applied in the form of a liquid by using a convenient method such as roll-coating or stamping. The Gyrex Company makes a roll-coater, model number 9, which may be used to perform a roll-coating for applying masking film 710. This application step is self-aligned and obviates the need for additional, tedious masking and alignment steps, which are common in patterning schemes of the prior art.

During the operation of an array of edge electron emitters, an individual edge electron emitter is selectively addressed by forming an electric field in the surrounding evacuated space by applying suitable voltages to cathode and the extraction electrode which address and define that particular edge electron emitter. The field strength varies with position in space and may be modeled. This model depends upon variables such as the configuration of cathodes 132, gates 515, layers 122, 124, 126, 128, the potential difference between cathodes 132 and gates 515, and the anode (not shown) voltage. It is desired to be understood that the scope of the present method is in no way limited to the aforementioned modeling procedure. The electron emission at edge electron emitters 530 may be optimized (maximize current, etc.) by positioning each of edge electron emitters 530 at a region in space wherein the characteristics of the electric field provide optimum electron emission characteristics. For example, edge emitters 530 may be positioned in those regions wherein the electric field strength is predetermined to be strongest.

In the present example, the edges of layers 128, 126, 124, are retracted from gate 515, in a direction toward an adjacent one of cathodes 132. To achieve this, and in accordance with the present invention, an outer, radial portion 726 of masking film 710 is first removed. Outer, radial portion 726 is defined by convex curved surface 720 and a dashed, curved line 728, which is shown in FIG. 9.

Figure 10:
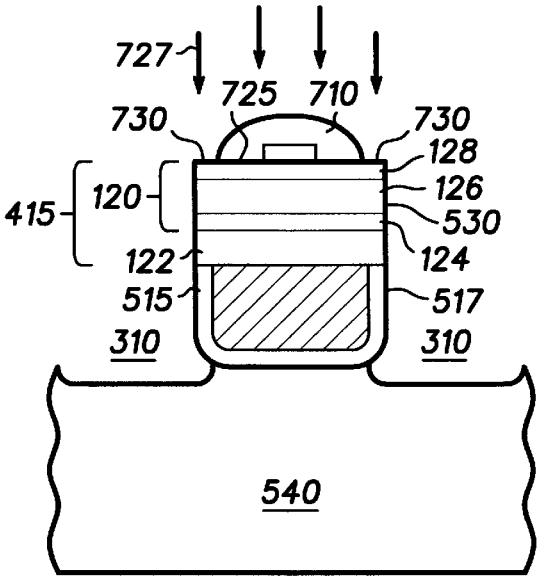

The edge-retracted configuration of masking film 710 is depicted in FIG. 10, which is a partial view of structure 700, similar to that of FIG. 9, and including only one of edge electron emitters 530. Thin outer edge 725 is retracted to a predetermined lateral position with respect to an edge 517 of an adjacent gate 515 of extraction electrode 540. The step of removing outer, radial portion 726 may be performed by one of various approaches.

In the preferred embodiment, the step of removing outer, radial portion 726 includes etching masking film 710 with a low energy plasma, indicated by arrows 727 in FIG. 10, such as a low energy oxygen plasma. The low energy plasma etch may be performed in a barrel asher, such as model number 421 made by Tegal. The etch rate is determined by variables such as the pressure of the plasma, the size of the chamber, and the material comprising masking film 710. The etch rate and duration of the etch are controlled so that outer, radial portion 726 is selectively removed. For the examples wherein positive photoresists comprise masking film 710, an etch time of about five minutes was suitable to retract inwardly thin outer edge a distance of about 5 micrometers. The oxygen plasma pressure in the barrel asher was 500 milliTorr. Convex curved surface 720 of masking film 710 is etched in a generally radially inward direction, thereby exposing an underlying surface 730, which is adjacent edge 415. The retracted thin outer edge 725 of masking film 710 defines a predetermined lateral position for edge electron emitter 530 with respect to edge 517 of adjacent gate 515. This plasma etch step does not require the use of a hard mask or involve the exposure and development of the resist. Moreover, no alignment step is required. It is also self-aligned and results in uniformity throughout the array of the distance between the retracted thin outer edge 725 and edge 415. This uniformity is independent of variation in the width of first grooves 310, which may occur due to error inherent in the sawing, or groove-forming, process.

In another embodiment, the step for removing outer, radial portion 726 includes, first, performing a short-duration exposure of masking film 710 to ultraviolet light. In this particular example, masking film 710 is made from a positive photoresist material. The duration of the exposure to the ultraviolet light is sufficient to expose outer, radial portion 726. Thereafter, the exposed outer, radial portion 726 is developed with a developing agent and thereby removed from masking film 710.

Figure 11:
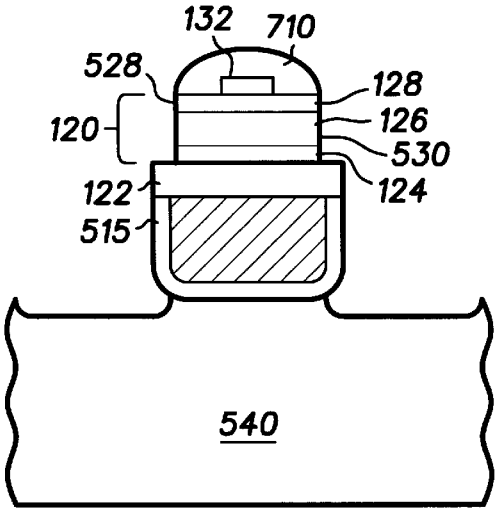

Referring now to FIG. 11, there is depicted a view similar to that of FIG. 10 of a structure 800 realized by performing on structure 700 the additional step of selectively, anisotropically etching emission structure 120 to create an edge 528 of emission structure 120. Second resistive layer 128, emissive layer 126, and first resistive layer 124 are etched using suitable etchants. For this particular embodiment, a suitable etchant for the amorphous silicon comprising layers 128, 124 includes trifluoromethane and $SF_6$ in helium; and a suitable etchant for a carbon-based material comprising emissive layer 126 includes oxygen in helium. In this particular example, dielectric layer 122 is not etched; in other examples, such as those described in greater detail with reference to FIGS. 18 and 21, an etchant including $C_2F_6$ in helium may be used to selectively etch the silicon dioxide. Dielectric layer 122 is utilized to insulate, and vertically space, emission structure 120 from gate 515.

Figure 12:
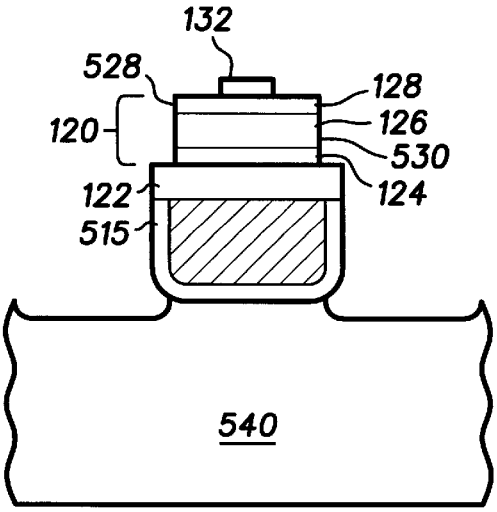

Referring now to FIG. 12, there is depicted a view similar to that of FIG. 11 of a structure 900 realized by performing upon structure 800 (FIG. 11) the additional step removing masking film 710 in accordance with the present invention. In the preferred embodiment, this may be achieved by, for example, dissolving masking film 710 with acetone or by exposing the entirety of masking film 710 to UV and thereafter developing masking film 710 with a developer.

In this particular embodiment, emission structure 120 includes first resistive layer 124, emissive layer 126, and second resistive layer 128.

In another embodiment, the emission structure includes only the emissive layer.

In yet another embodiment, the emission structure includes any one of the multi-layer emitter assemblies disclosed in "Ballistic Charge Transport Device with Integral Active Contaminant Absorption Means", U.S. Pat. No. 5,502,348, filed on Dec. 17, 1993.

In the present embodiment, first and second resistive layers 124, 128 are included to provide ballasting. The reason for providing the setback in cathodes 132 from edge electron emitters 530, as illustrated in FIG. 12, is to provide a proper lateral ballast resistance therebetween. The portions of resistive layers 124 and/or 128 between cathode 132 and edge electron emitter 530 act as a lateral ballast resistor. The primary determinants of the amount of resistance supplied by the ballast resistor are the materials comprising layers 124, 126, 128 and the distance between cathode 132 and edge electron emitter 530. The incorporation of ballasting resistors in the array of edge electron emitters provides uniform current distribution throughout the array. Other configurations of an emission structure will occur to one skilled in the art. For these other configurations, the step of selectively etching the emission structure will include the use of appropriate etchant(s) for etching the material(s) included therein. For example, the emissive layer may include an electron emissive material which provides a resistance that obviates the need for the first and/or second resistive layers.

Referring now to FIGS. 13–19, there are depicted views, similar to that of FIG. 4, of structures realized by performing the steps of another embodiment of a method for fabricating an array of edge electron emitters 530 in accordance with the present invention. In this particular embodiment, the steps of forming in supporting substrate 110 plurality of parallel, laterally spaced apart first grooves 310 in first planar surface 101 and forming plurality of parallel, laterally spaced apart second grooves 320 in second planar surface 102, are performed prior to the steps of forming dielectric layer 122, forming emission structure 120, and forming cathodes 132.

Figure 13:
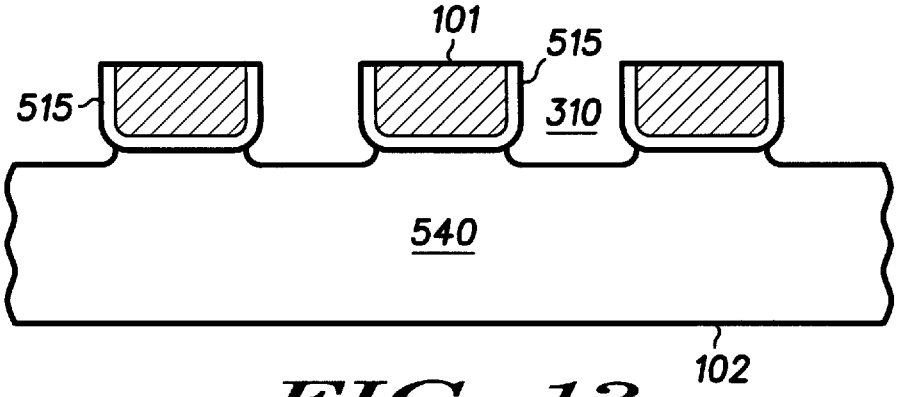
FIGS. 13–19 are views similar to that of FIG. 4 of structures realized by performing various steps of another embodiment of a method for fabricating an array of edge electron emitters, in accordance with the present invention.
Figure 14:
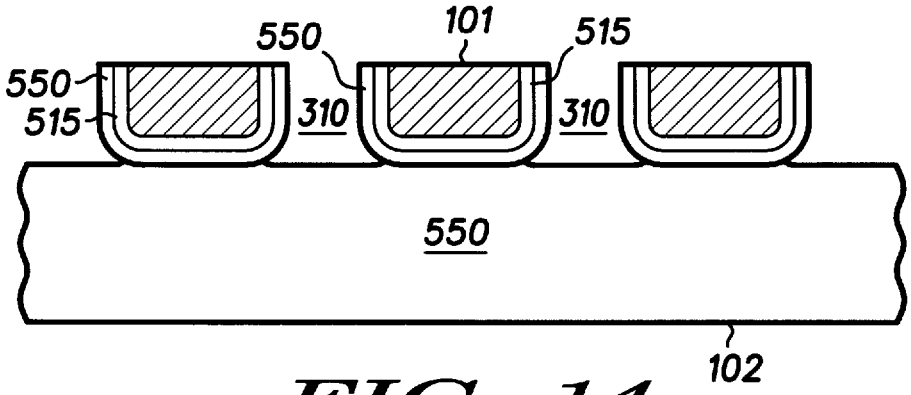

In the present embodiment, first and second grooves 310 and 320 are formed by saw cutting supporting substrate 110 from first planar surface 101 and then from second planar surface 102, respectively. To minimize chipping and other defects during the sawing operation and to provide relatively sharp and well defined edges, first and second planar surfaces 101 and 102 of supporting substrate 110 are first coated with a layer of metallic or organic material. After first and second grooves 310 and 320 are formed in supporting substrate 110, the coating is removed by any convenient process, generally depending upon the type of material used in the coating. Thereafter, as illustrated in FIG. 13, extraction electrodes 540, including gates 515, are formed in the manner described with reference to FIGS. 7 and 8. Thereafter, as illustrated in FIG. 14, a spacer layer 550 is formed on extraction electrodes 540. Spacer layer 550 is formed in a manner similar to that used to form extraction electrodes 540. Spacer layer 550 may be made from a sacrificial material, such as aluminum or silicon nitride. Spacer layer 550 protects the material comprising extraction electrodes 540 during the step of patterning cathodes 132 because, in this particular embodiment, extraction electrodes 540 and cathodes 132 are made of the same material, which in this example includes aluminum.

In a further embodiment, extraction electrodes 540 and cathodes 132 are made from different materials. This obviates the need to protect extraction electrodes 540 during the patterning of cathodes 132, so that spacer layer 550 may be omitted.

Figure 15:
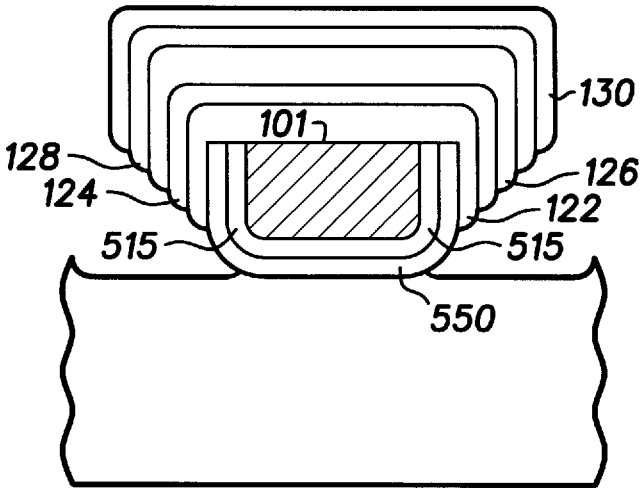
Figure 16:
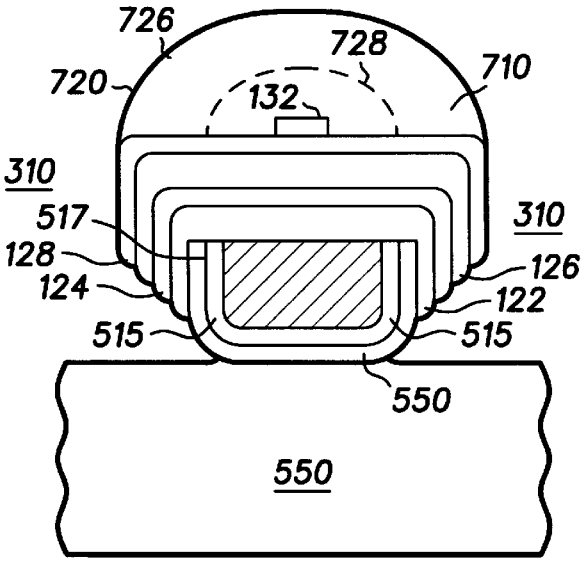

As will be described in greater detail with reference to FIGS. 20–22, spacer layer 550 may also be employed to realize a predetermined disposition of edge electron emitter 530 at a location spaced from gate 515, in a direction away from cathode 132. The material used to form spacer layer 550 is removed from first planar surface 101 by a convenient method, such as polishing. The gate material is also removed from first planar surface 101 and second planar surface 102 by a convenient method, such as polishing. In this manner, each of extraction electrodes 540 is electrically isolated from the others of extraction electrodes 540. Next, as illustrated in FIG. 15, layers 122, 124, 126, 128, 130 are deposited as blanket layers upon first planar surface 101, in the manner described with reference to FIG. 1. Thereafter, as shown in FIG. 16, cathodes 132 are formed by patterning conductive layer 130, in the manner described with reference to FIG. 2. Then, also illustrated in FIG. 16, masking film 710 is formed, in the manner described with reference to FIG. 9. In this particular embodiment, the applied liquid comprising masking film 710 does not flow onto the surfaces facing first groove 310, including the surfaces of second resistive layer 128 which face first groove 310.

Thereafter, and in accordance with the present invention, outer, radial portion 726 of masking film 710 is removed. Outer, radial portion 726 is defined by convex curved surface 720 and dashed, curved line 728, which is shown in FIG. 16. Outer, radial portion 726 is removed in the manner described with reference to FIG. 10, thereby forming a mask for subsequent etching steps to achieve a predetermined lateral disposition of edge electron emitter 530. In this particular example, edge electron emitter 530 is made flush with edge 517 of gate 515. Thus, as illustrated in FIG. 17, masking film 710 is processed so that thin outer edge 725 is generally aligned with edge 517 of gate 515.

Figure 18:
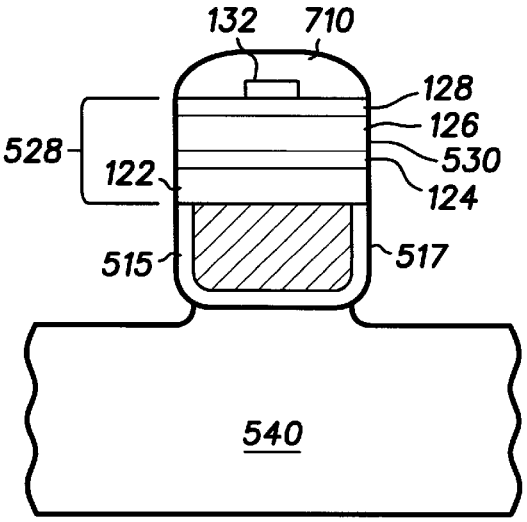
Figure 19:
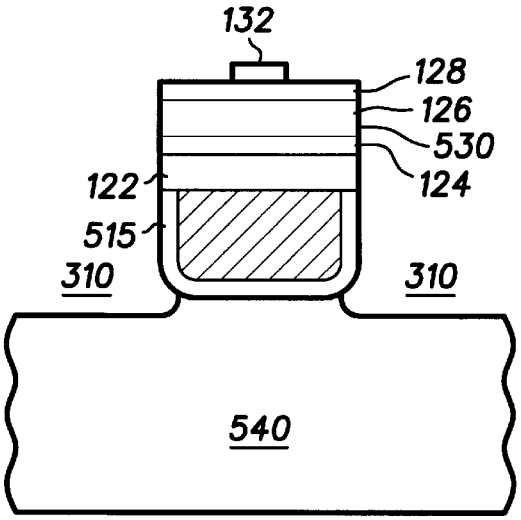

Thereafter, as shown in FIG. 18, layers 128, 126, 124, 122 are anisotropically etched to define edge 528 being aligned with edge 517 of gate 515. Then, as also illustrated in FIG. 18, spacer layer 550 is removed by selectively etching using a suitable etchant, such as a low pressure $SF_6$ plasma (for silicon nitride) or a low pressure chlorine plasma (for aluminum). As shown in FIG. 19, masking film 710 is removed in the manner described with reference to FIG. 12.

In this manner, an array, having the general configuration depicted in FIG. 3, of edge electron emitters 530 is fabricated, in accordance with the present invention.

Figure 17:
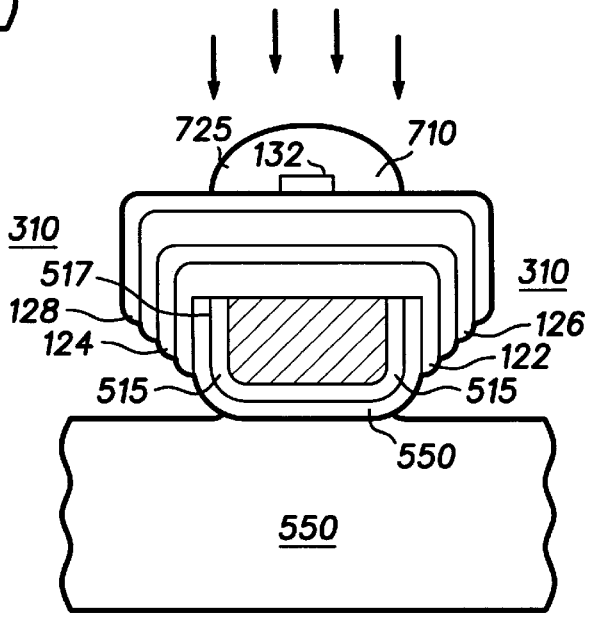
Figure 20:
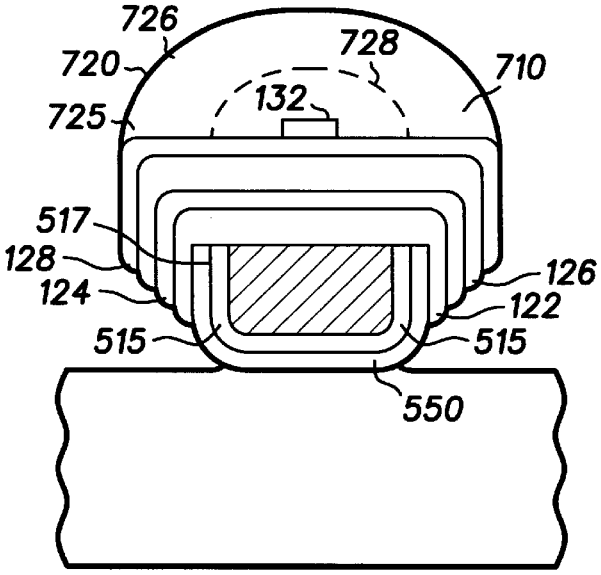
FIGS. 20–22 are views similar to that of FIG. 15 of structures realized by performing various steps of another embodiment of a method for fabricating an array of edge electron emitters, in accordance with the present invention.
Figure 21:
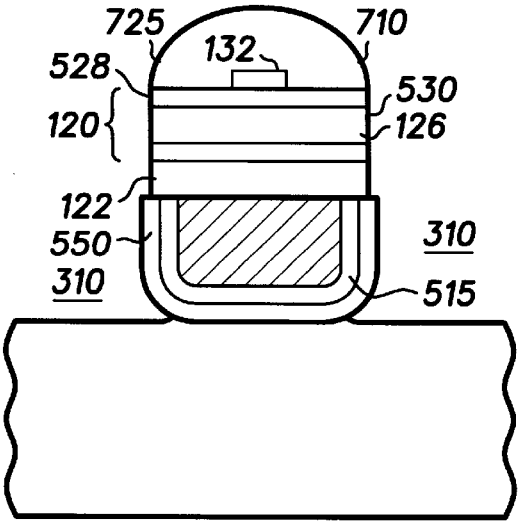
Figure 22:
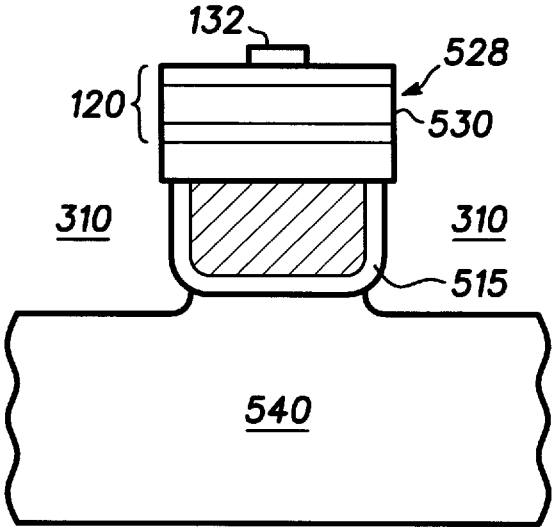

Referring now to FIGS. 20–22, there are depicted views, similar to those of FIGS. 17–19, respectively, of structures realized by performing various steps of another embodiment of a method, in accordance with the present invention. In this particular embodiment, a configuration is realized wherein edge electron emitters 530 are laterally displaced from gate 515 in a direction away from cathode 132. Spacer layer 550 provides a support for layers 128, 126, 124, 122 so that they may extend a predetermined lateral distance beyond edge 517 of gate 515.

Masking film 710 is formed and then etched, or UV-exposed and developed, to achieve a predetermined configuration, in the manner described with reference to FIG. 10. In this particular embodiment, the retracted thin outer edge 725 of masking film 710 is in registration with the portion of spacer layer 550 which covers gate 515. Then, as depicted in FIG. 21, layers 128, 126, 124, 122 are anisotropically etched to form an edge, including edge 528 of emission structure 120, which extends beyond gate 515, in a direction away from cathode 132. Thereafter, masking film 710 and spacer layer 550 are removed, as illustrated in FIG. 22. In the present embodiment, edge electron emitter 530 is laterally spaced, in a direction away from cathode 132, from adjacent gate 515. The thickness of spacer layer 550 is predetermined to achieve this configuration.

Edge 528 of emission structure 120 includes edge electron emitter 530. Edge electron emitter 530 includes a portion of the edge of emissive layer 126, said portion facing first groove 310 and the length of which is defined by gate 515; equivalently, that length of the edge of emissive layer 126 which is caused to emit electrons, upon the application of suitable potentials at the defining gate 515 and cathode 132, comprises edge electron emitter 530. A plurality of edge electron emitters 530 are disposed along a continuous edge of emissive layer 126 and are defined by plurality of gates 515 of extraction electrode 540 (see configuration of FIG. 7). The present method realizes a predetermined configuration of edge electron emitter 530 with respect to an adjacent gate 515 and cathode 132.

In summary, a method has been disclosed for fabricating an array of edge electron emitters suitable for use in a field emission display. This method includes steps for realizing a predetermined configuration between the edge electron emitter and the gate extraction electrode, to optimize emission at the edge electron emitter. The steps for positioning the edge electron emitter are self-aligned and obviate the need to perform high precision alignment steps, such as hardmask alignment. They are also simple to perform and provide high uniformity of the configuration over the array.

While We have shown and described specific embodiments of the present invention, further modifications and improvements will occur to those skilled in the art. We desire it to be understood, therefore, that this invention is not limited to the particular forms shown and We intend in the appended claims to cover all modifications that do not depart from the spirit and scope of this invention.

We claim:

1. A method for fabricating an array of edge electron emitters, comprising the steps of:

providing a plate shaped, dielectric supporting substrate having a first planar surface and a second planar surface positioned in parallel opposed relationship with a selected thickness therebetween;

forming a plurality of parallel, laterally spaced apart first grooves in the first planar surface to a first depth thereby realizing a plurality of lands;

forming a second groove in the second planar surface to a second depth, positioning the second groove so that the second groove crosses each of the plurality of parallel, laterally spaced apart first grooves at an angle, the first and second depths combined being greater than the thickness of the supporting substrate so that a plurality of openings are formed through the supporting substrate one each at the areas of regions wherein one of the first grooves crosses the second groove;

forming an extraction electrode including the step of depositing, on the surfaces defining the first grooves and facing the openings and on the surfaces defining the second groove, a layer of a conductive material, the extraction electrode defining on said portion of the surfaces defining the first grooves a plurality of gates;

forming a dielectric layer on the first planar surface of the supporting substrate;

forming an emission structure on the dielectric layer, the emission structure being spaced a predetermined vertical distance from an adjacent one of plurality of gates by the dielectric layer;

forming a plurality of cathodes on the emission structure, the plurality of cathodes being disposed one each on the plurality of lands so that each of the plurality of cathodes extends over the length of one of the plurality of lands;

forming a masking film on the plurality of cathodes and on the emission structure, the masking film having a convex curved surface and a thin outer edge;

removing an outer, radial portion of the masking film thereby retracting the thin outer edge of the masking film to a predetermined lateral position with respect to an edge of the adjacent one of plurality of gates of the extraction electrode; and selectively etching the emission structure to define an edge of the emission structure, the adjacent one of plurality of gates of the extraction electrode defining one of the plurality of edge electron emitters including an addressable portion of the edge of the emission structure thereby disposing each of the plurality of edge electron emitters at a predetermined position wherein optimum electric field conditions and electron emission conditions exist.

2. The method for fabricating the array of edge electron emitters as claimed in claim 1, wherein the step of forming the masking film includes roll-coating a liquid resist material.

3. The method for fabricating the array of edge electron emitters as claimed in claim 2, wherein the liquid resist material includes a positive photoresist material.

4. The method for fabricating the array of edge electron emitters as claimed in claim 1, wherein the step of removing the outer, radial portion of the masking film includes etching the convex curved surface.

5. The method for fabricating the array of edge electron emitters as claimed in claim 4, wherein the step of etching the convex curved surface includes etching with an oxygen plasma.

6. The method for fabricating the array of edge electron emitters as claimed in claim 1, wherein the step of removing the outer, radial portion of the masking film includes the steps of exposing the masking film to ultraviolet light for a length of time sufficient to expose the outer, radial portion and thereafter developing the outer, radial portion, thereby removing the outer radial portion from the masking film.

7. The method for fabricating the array of edge electron emitters as claimed in claim 1, further including, prior to the step of forming the emission structure, the step of forming a spacer layer on the plurality of gates.

8. The method for fabricating the array of edge electron emitters as claimed in claim 7, further including, subsequent the step of forming the emission structure, the step of removing the spacer layer.

9. The method for fabricating the array of edge electron emitters as claimed in claim 1, wherein the emission structure includes an emissive layer made from an emissive material being selected from a group consisting of diamond, diamond-like carbon, non-crystalline diamond-like carbon, partially graphitized nanocrystalline carbon, and aluminum nitride.

10. The method for fabricating the array of edge electron emitters as claimed in claim 9, wherein the emission structure further includes resistive layers of electrically resistive material positioned on each side of the emissive layer.

11. An array of edge electron emitters produced in accordance with the method of claim 1.

* * * * *